US006591531B1

(12) United States Patent
Wiebe

(10) Patent No.: US 6,591,531 B1
(45) Date of Patent: Jul. 15, 2003

(54) SAFETY TRIGGERING SYSTEM FOR A NON-LETHAL WEAPON AND METHOD THEREFOR

(76) Inventor: Edward Wiebe, 8155 E. Roosevelt St., Apt. 108, Scottsdale, AZ (US) 85257

( * ) Notice: Subject to any disclaimer, the term of this patent is extended or adjusted under 35 U.S.C. 154(b) by 0 days.

(21) Appl. No.: 10/053,379

(22) Filed: Jan. 17, 2002

(51) Int. Cl.[7] ..... F41A 17/00
(52) U.S. Cl. ..... 42/70.11
(58) Field of Search ..... 42/70.11, 70.06

(56) References Cited

U.S. PATENT DOCUMENTS

| | | | | | |
|---|---|---|---|---|---|
| 3,939,679 | A | * | 2/1976 | Barker et al. | 70/277 |
| 4,003,152 | A | * | 1/1977 | Barker et al. | 42/70.01 |
| 4,354,189 | A | * | 10/1982 | Lemelson | 340/5.61 |
| 4,488,370 | A | | 12/1984 | Lemelson | 42/70.11 |
| 5,062,232 | A | | 11/1991 | Eppler | 42/70.11 |
| 5,301,448 | A | * | 4/1994 | Petrick et al. | 42/70.01 |
| 5,461,812 | A | | 10/1995 | Bennett | 42/70.11 |
| 5,675,925 | A | | 10/1997 | Wurger | 42/70.11 |
| 5,755,056 | A | | 5/1998 | Danner et al. | 42/84 |
| 5,867,930 | A | * | 2/1999 | Kaminski et al. | 42/70.11 |
| 5,896,691 | A | * | 4/1999 | Kaminski et al. | 42/70.11 |
| 5,937,557 | A | * | 8/1999 | Bowker et al. | 42/70.01 |
| 5,949,338 | A | | 9/1999 | Masi et al. | 340/573.1 |
| 5,953,844 | A | | 9/1999 | Harling et al. | 42/70.06 |
| 5,966,859 | A | * | 10/1999 | Samuels | 42/70.11 |
| 6,219,952 | B1 | * | 4/2001 | Mossberg et al. | 42/70.01 |
| 6,237,271 | B1 | | 5/2001 | Kaminski | 42/70.06 |
| 6,282,829 | B1 | * | 9/2001 | Mossberg et al. | 42/70.11 |
| 6,283,034 | B1 | * | 9/2001 | Miles, Jr. | 102/430 |
| 6,343,429 | B1 | * | 2/2002 | Mossberg et al. | 42/70.01 |
| 2002/0032976 | A1 | * | 3/2002 | Riener | 42/70.11 |
| 2002/0069570 | A1 | * | 6/2002 | Lee | 42/70.11 |

* cited by examiner

*Primary Examiner*—Michael J. Carone
*Assistant Examiner*—Denise J Buckley
(74) *Attorney, Agent, or Firm*—LaValle D. Ptak

(57) ABSTRACT

A safety triggering mechanism for a non-lethal weapon has a trigger for discharging the weapon. A control circuit is coupled to the trigger. The control circuit will only allow the trigger to discharge the weapon when a light signal transmitted by the control circuit is reflected back to the control circuit.

9 Claims, 5 Drawing Sheets

Cover-Top View - Fig. 2

The Enclosure Cover-Side View

Cover-Side View

SAFETY TRIGGERING SYSTEM FOR A NON-LETHAL WEAPON AND METHOD THEREFOR

BACKGROUND OF THE INVENTION

1. Field of the Invention

This invention relates generally to weapons, and more specifically, to a safety triggering system for a non-lethal weapon which will only allow the non-lethal weapon to be discharged in an enclosed area. The safety triggering mechanism may be adapted to be used on other types of weapons as well.

2. Background of the Invention

As the crime rate increases, more and more people are arming themselves with weapons for protection. A problem arises in the fact that many people are using these weapons for offensive purposes. Many people are using these weapons not to protect themselves from home invasion but to commit crimes.

Many different types of patents have been written which attempt to protect individuals from the accidental discharge of the weapon. Other patents have been written which will only allow certain individuals to discharge the weapon. However, presently, there are no systems which will only allow a non-lethal weapon to be used for home defense. In order to protect people from the offensive use of non-lethal weapons, a triggering system which would only permit the discharge of the non-lethal weapon in the enclosed confines of a home will prevent many crimes from being committed.

Therefore, a need existed to provide an improved safety triggering system for a non-lethal weapon. The improved safety triggering system will only allow the non-lethal weapon to be used in enclosed areas. The improved triggering safety system will thus prevent the non-lethal weapon from being used outdoors in the commission of a criminal offense.

SUMMARY OF THE INVENTION

In accordance with one embodiment of the present invention, it is an object of the present invention to provide an improved safety triggering mechanism.

It is another object of the present invention to provide an improved safety triggering mechanism which will only allow a non-lethal weapon to be discharged in an enclosed area.

It is still another object of the present invention to provide an improved safety triggering mechanism which will only allow a non-lethal weapon to be discharged in an enclosed area thereby preventing the non-lethal weapon from being used outdoors to commit a criminal offense.

BRIEF DESCRIPTION OF THE PREFERRED EMBODIMENTS

In accordance with one embodiment of the present invention, a safety triggering mechanism for a weapon is disclosed. The safety triggering mechanism has a trigger for discharging the weapon. A control circuit is coupled to the trigger. The control circuit will only allow the trigger to discharge the weapon when a light signal transmitted by the control circuit is reflected back to the control circuit.

In accordance with another embodiment of the present invention, a method of providing a safety triggering mechanism for a safe discharge of a weapon is disclosed. The method comprises the steps of: providing a safety triggering mechanism coupled to the weapon comprising: a trigger for discharging the weapon; and a control circuit coupled to the trigger which will only allow the trigger to discharge the weapon when a light signal transmitted by the control circuit is reflected back to the control circuit activating the control circuit; transmitting the light signal by the control circuit; receiving the transmitted light signal back to the control circuit; and pulling the trigger to discharge the weapon when the light signal transmitted by the control circuit is reflected back to the control circuit.

The foregoing and other objects, features, and advantages of the invention will be apparent from the following, more particular, description of the preferred embodiments of the invention, as illustrated in the accompanying drawing.

BRIEF DESCRIPTION OF THE DRAWINGS

The novel features believed characteristic of the invention are set forth in the appended claims. The invention itself, as well as a preferred mode of use, and advantages thereof, will best be understood by reference to the following detailed description of illustrated embodiment when read in conjunction with the accompanying drawings, wherein like reference numerals and symbols represent like elements.

DETAILED DESCRIPTION

Figure 1:
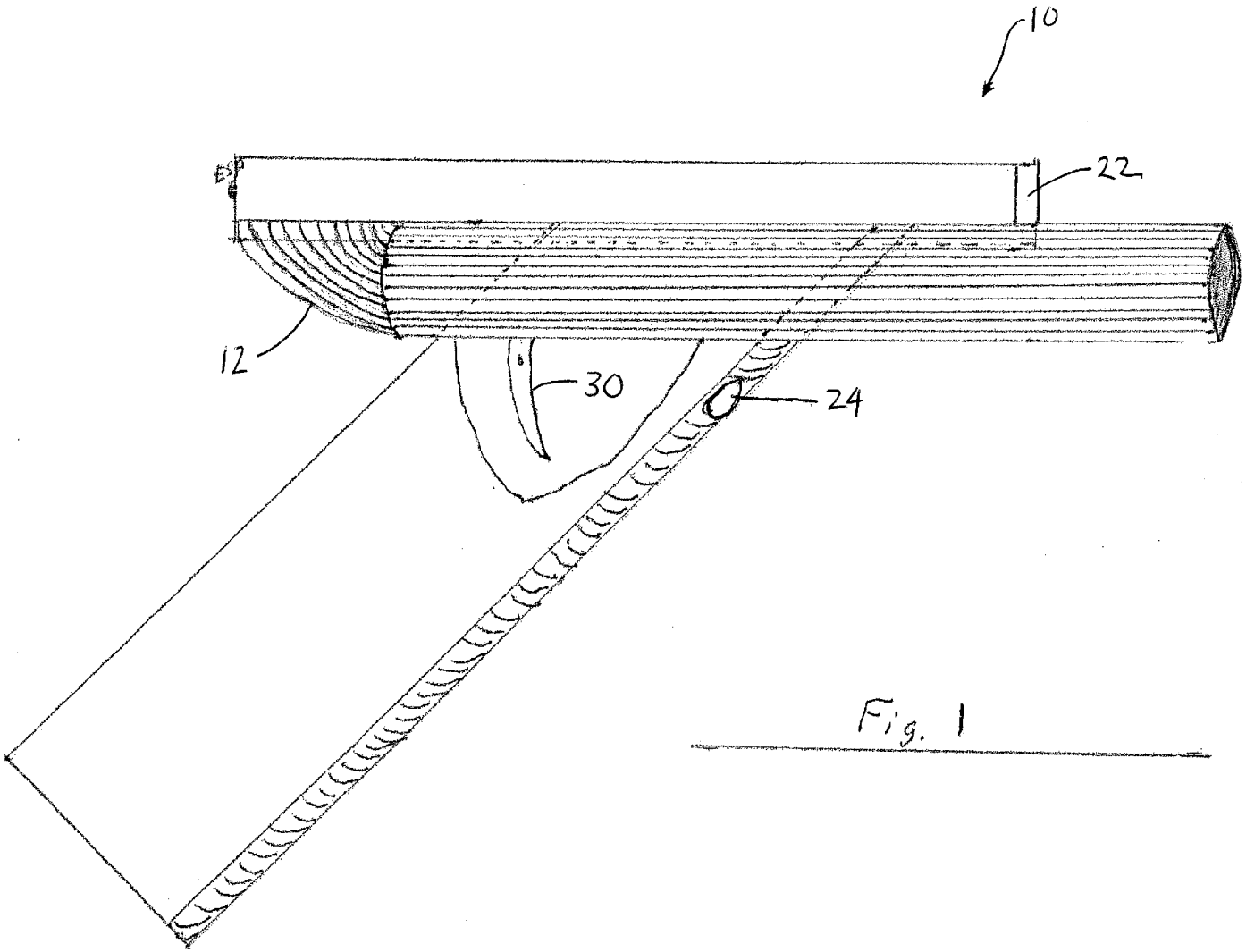
FIG. 1 is a side view of a non-lethal weapon incorporating the safety triggering mechanism of the present invention.
Figure 2:
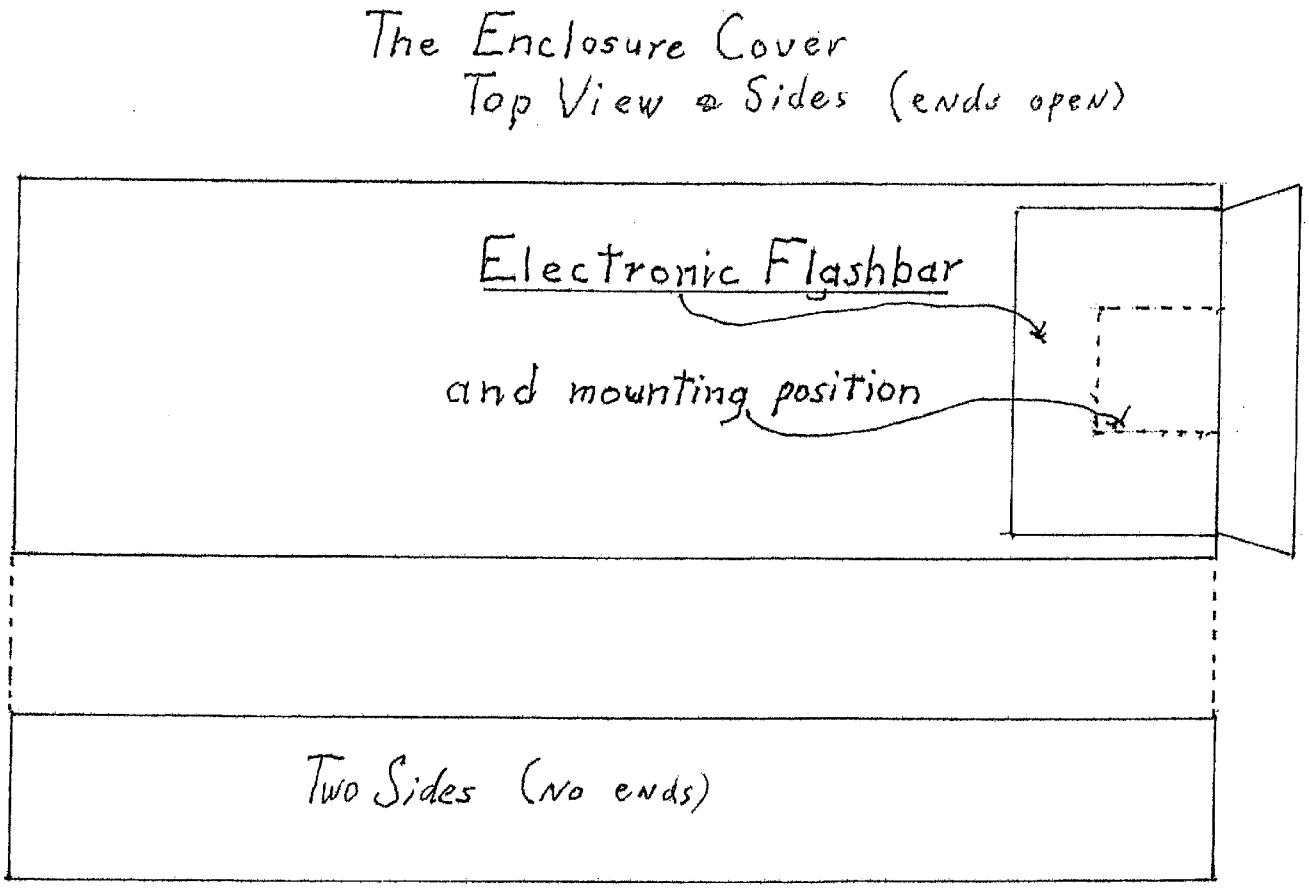
FIG. 2 is a top view of the enclosure cover used in the safety triggering mechanism of the present invention.
Figure 3:
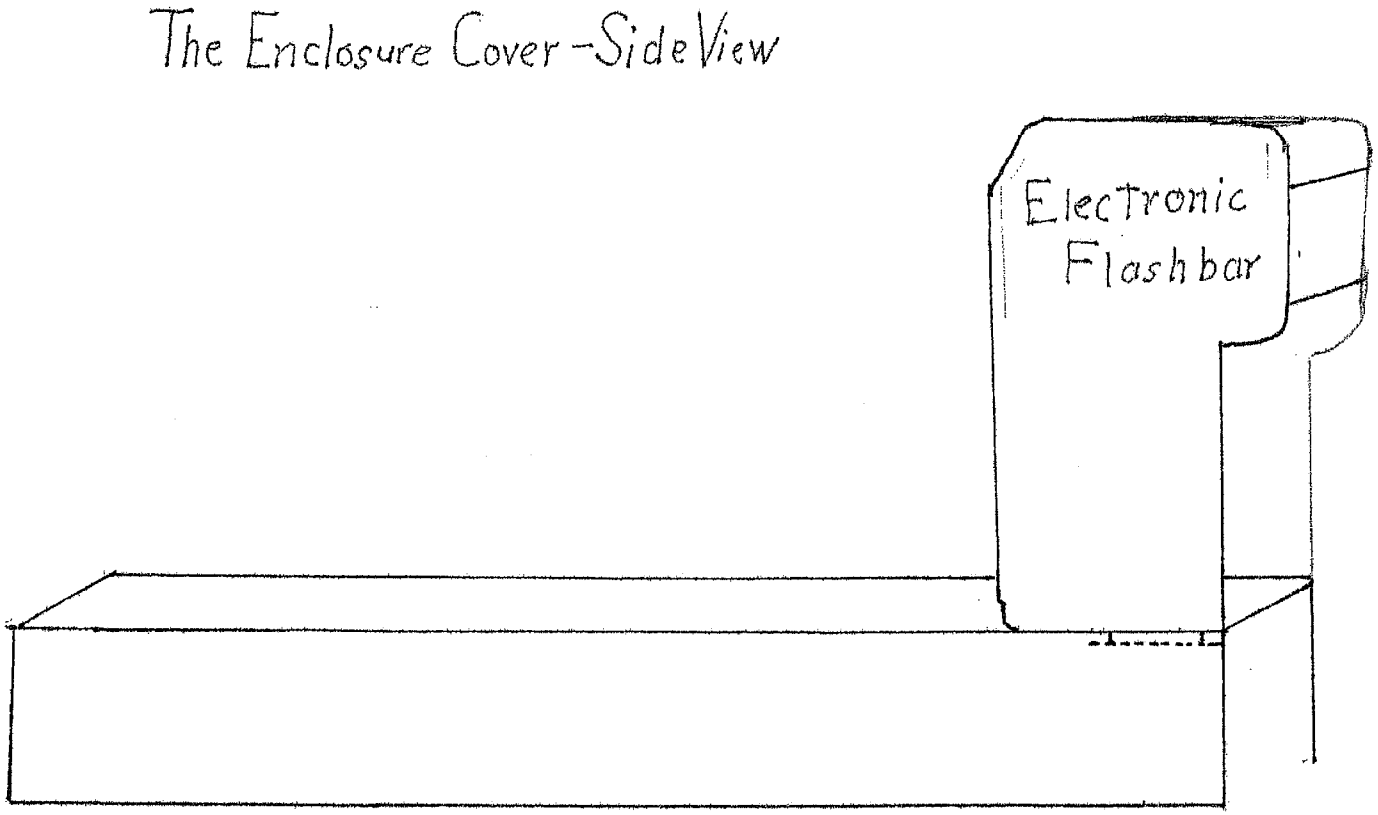
FIG. 3 is a side view of the enclosure cover used in the safety triggering mechanism of the present invention.
Figure 4:
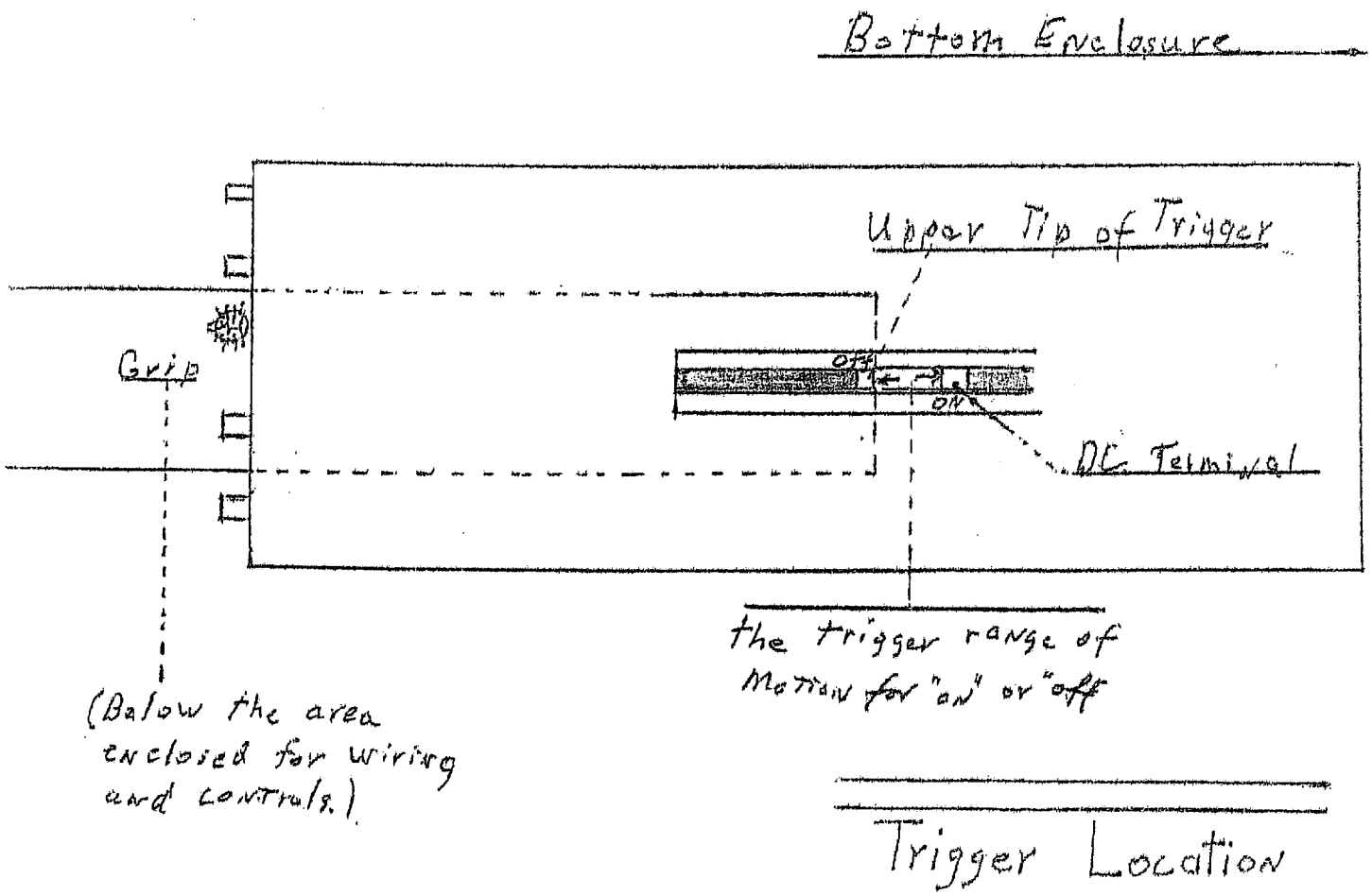
FIG. 4 is a bottom view of the enclosure cover used in the safety triggering mechanism of the present invention.
Figure 5:
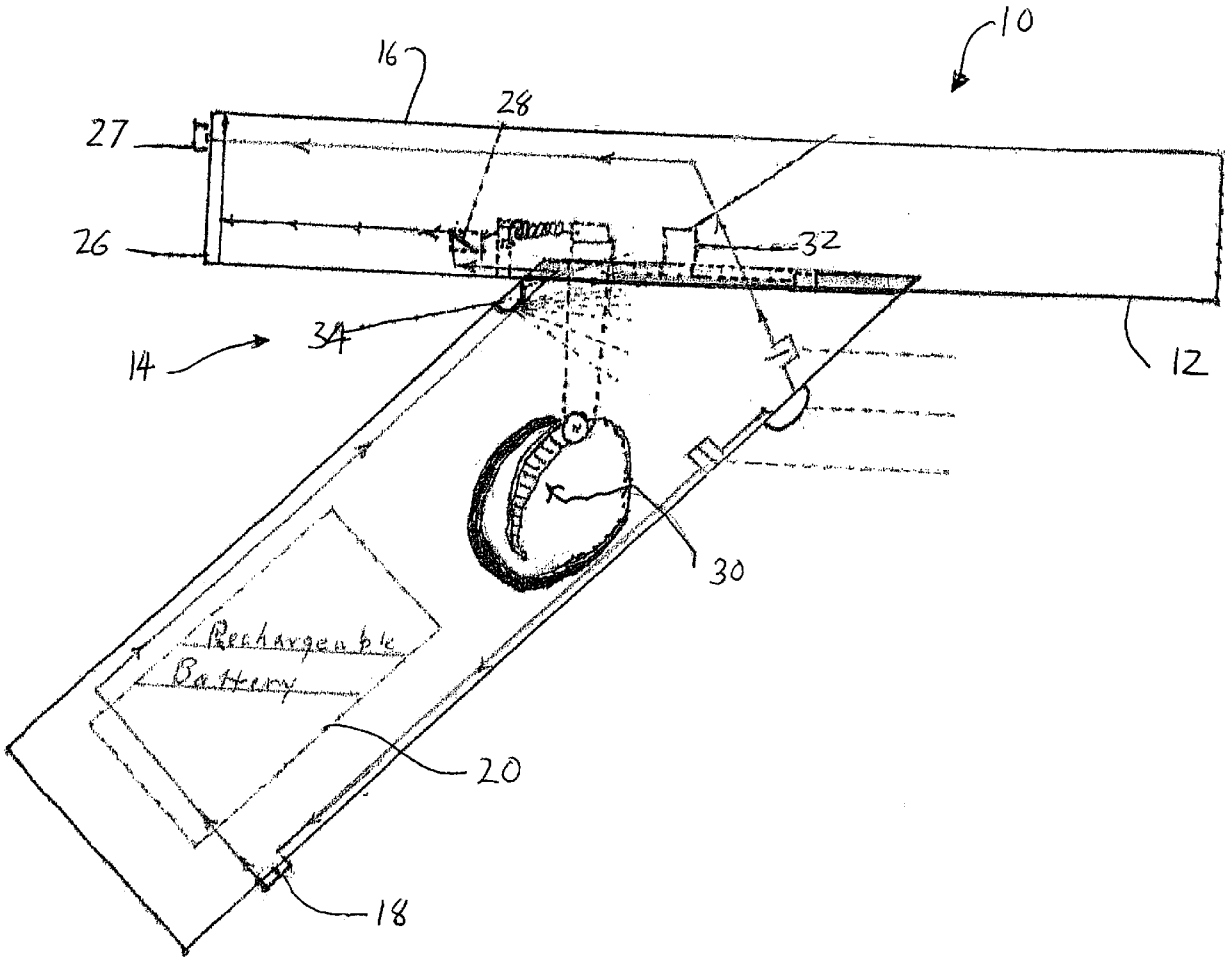
FIG. 5 is a simplified block diagram of the safety triggering mechanism of the present invention.

Referring now to the Figures, a safety triggering mechanism 10 (hereinafter mechanism 10) is shown. The mechanism 10 is used to only allow a non-lethal weapon 12 to be fired within an enclosed area. Thus, the non-lethal weapon 12 may only be discharged in a home or building. The mechanism 10 will thus benefit the homeowner/business owner by protecting them from charges and/or lawsuits for the unreasonable use of force while still allowing them to protect their home/business from an intruder. Furthermore, the mechanism 10 would prevent criminals from committing crimes in an open environment area. It should be noted that the mechanism 10 may be embodied in various different types of non-lethal weapons and/or firearms in various different forms and embodiments.

The mechanism 10 will generally have control circuitry 14 located within an enclosure 16 which is coupled to the non-lethal weapon 12. The control circuitry 14 will have an activation switch 18. The activation switch 18 is used to activate and deactivate the control circuitry 14 and hence the non-lethal weapon 12.

Once the activation switch 18 is placed in an "ON" position, power from a power source 20 flows to the control circuitry 14 and to the non-lethal weapon 10. The power source 20 may be any type of power source. In general a DC power source is used. The DC power source may be a battery, a rechargeable battery, or the like.

The power source 20 will send a current to a transmitter 22. The transmitter 22 will then flood the area with a light source. The light source may be any type of light. For example, infrared, ultraviolet, a light flash similar to a photography light flash, a halogen light beam, and the like may be used. It should be noted that the listing of the above identified light sources are used as an example and should not be seen as to limit the scope of the present invention. A light source having a wavelength sufficient to reflect off a surface is generally used. The transmitted light source will be reflected around the enclosed area.

A receiver 24 located on the non-lethal weapon will monitor and receive any reflected light source. The receiver 24 will verify that the light source received by the receiver 24 is the same (i.e., same wavelength, frequency, etc.) as that transmitted by the transmitter 22. If the light source received by the receiver 24 is the same as that transmitted by the transmitter 22, the receiver 24 will send a signal to a power bar 26. The power bar 26 will arm the non-lethal weapon 12. A signal light 27 will illuminate when the non-lethal weapon 12 is armed and the mechanism 10 is ready to discharge the non-lethal weapon 12.

When the mechanism 10 is activated, a signal is sent to safety switch 28. The operator by pressing and holding the trigger 30 and the safety switch 28 will couple a conductor 30 between the power bar 26 and a contact 32. This will provide power to discharge the non-lethal weapon 12. When the trigger 30 is released, the trigger 30 is separated from the contact 32 by means of a magnet 34. Further, the safety switch 28 will revert back to an its original position forming an "open" circuit in the control circuitry 14.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A safety triggering system for a weapon used in an enclosed area including in combination:

a power source;

a trigger circuit including first and second series connected switches in circuit between the power source and a weapon to discharge the weapon upon closure of both the first and second switches;

a control circuit having a light source and a reflected light receiver, with an activation switch coupled between the power source and the light source for transmitting light with predetermined characteristics from the safety triggering system upon operation of the activation switch; and means coupling the reflected light receiver with the first switch to close the first switch in response to receipt by the reflected light receiver of reflected light having the same predetermined characteristics as the transmitted light to permit discharge of the weapon by closure of the second switch by the operator of the weapon.

2. A safety triggering system for a weapon in accordance with claim 1 further including:

a safety switch connected in the trigger circuit with the first and second switches to couple the power source with the weapon when the safety switch and the first and second series connected switches are closed.

3. A safety triggering system for a weapon in accordance with claim 1 further including a signal light coupled with the power source and with the activation switch for providing visual indication of the operating condition of the safety triggering system.

4. A safety triggering system for a weapon in accordance with claim 1 wherein the light source is a halogen light source.

5. A safety triggering system for a weapon in accordance with claim 1 wherein the light source is a light flash source.

6. A method for providing safety triggering for safe discharge of a weapon including the steps of:

equipping the weapon with a trigger switch for discharging the weapon;

providing a control circuit coupled to the trigger switch for preventing the trigger switch from discharging the weapon until predetermined conditions are achieved;

transmitting a light signal from the control circuit to initiate the predetermined conditions;

receiving a reflected light signal from.the transmitted light signal for activating the control circuit, whereupon subsequent operation of the trigger switch discharges the weapon.

7. The method according to claim 6 wherein the step of receiving the reflected light signal to activate the control circuit is effect by comparing the parameters of the reflected light signal received by the control circuit with the parameters of the light transmitted.

8. The method according to claim 6 further including the step of providing a safety switch for preventing undesired discharge of the weapon by operation of the trigger switch, irrespective of the operation of the remainder of the system.

9. The method according to claim 6 whereupon the step of transmitting a light signal transmits a light signal having predetermined characteristics and the step of receiving the transmitted light signal responds to light signals of those same predetermined characteristics.

* * * * *